US006998213B2

(12) United States Patent
Aso et al.

(10) Patent No.: US 6,998,213 B2
(45) Date of Patent: Feb. 14, 2006

(54) THERMAL TRANSFER FILM, THERMAL TRANSFER RECORDING MEDIUM, AND METHOD FOR IMAGE FORMATION USING THE SAME

(75) Inventors: Kenichi Aso, Shinjuku-Ku (JP); Yoshihiko Tamura, Shinjuku-Ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/244,603

(22) Filed: Sep. 17, 2002

(65) Prior Publication Data

US 2003/0138719 A1 Jul. 24, 2003

(30) Foreign Application Priority Data

Sep. 18, 2001 (JP) ..... 2001-283696
Sep. 27, 2001 (JP) ..... 2001-295989
Sep. 27, 2001 (JP) ..... 2001-296939

(51) Int. Cl.

| | |
|---|---|
| ***G03C 1/805*** | (2006.01) |
| ***G03C 11/08*** | (2006.01) |
| ***B44C 1/165*** | (2006.01) |
| ***B41M 5/20*** | (2006.01) |
| ***G03G 8/00*** | (2006.01) |

(52) U.S. Cl. ..... 430/126; 430/104; 430/200; 430/256; 430/262; 430/961; 156/230; 156/240; 428/32.38; 428/32.86; 503/227

(58) Field of Classification Search ..... 430/256, 430/200, 262, 263, 259, 201, 17, 18, 126, 430/104, 961; 156/230, 240; 347/105; 503/227; 428/32.38, 32.86

See application file for complete search history.

(56) References Cited

U.S. PATENT DOCUMENTS

| | | | | |
|---|---|---|---|---|
| 5,071,502 | A * | 12/1991 | Hashimoto et al. | 430/200 |
| 5,300,398 | A * | 4/1994 | Kaszczuk | 430/259 |
| 5,512,931 | A | 4/1996 | Nakajima et al. | 347/213 |
| 5,759,738 | A * | 6/1998 | Tsuno et al. | 430/259 |
| 6,475,695 | B2 * | 11/2002 | Kuroki et al. | 430/259 |
| 6,733,611 | B2 * | 5/2004 | Hayashi et al. | 156/230 |
| 2002/0039641 | A1 * | 4/2002 | Hayashi et al. | 428/195 |

FOREIGN PATENT DOCUMENTS

| | | |
|---|---|---|
| EP | 0 424 037 A2 | 4/1991 |
| EP | 0 982 150 A2 | 3/2000 |
| JP | 01-237194 A | 9/1989 |
| JP | 09011674 | 1/1997 |
| WO | WO 01/2448 A1 | 2/2001 |

* cited by examiner

*Primary Examiner*—Richard L. Schilling
(74) *Attorney, Agent, or Firm*—Oliff & Berridge, PLC

(57) ABSTRACT

There are provided a thermal transfer film which can yield an image formed object possessing excellent fastness or resistance properties such as excellent abrasion resistance and lightfastness, has good sensitivity in transfer, and is free from blocking during storage in a roll form, a thermal transfer recording medium, and a method for image formation using them. The thermal transfer film comprises: a substrate; and one or a plurality of layers provided on one side of the substrate, the one or plurality of layers including at least a thermal transfer layer, the thermal transfer layer being located on the uppermost surface of the thermal transfer film, the thermal transfer layer comprising at least two polyester resins different from each other in number average molecular weigh.

1 Claim, 3 Drawing Sheets

THERMAL TRANSFER FILM, THERMAL TRANSFER RECORDING MEDIUM, AND METHOD FOR IMAGE FORMATION USING THE SAME

BACKGROUND OF THE INVENTION

1. Field of the Invention

The present invention relates to a thermal transfer film, a thermal transfer recording medium, and a method for image formation using a combination of the thermal transfer film with the thermal transfer recording medium.

2. Prior Art

Thermal transfer can easily record variable information and thus is extensively used in a wide variety of applications. The thermal transfer is a method which comprises the steps of: putting a thermal transfer film, comprising a colorant layer provided on a substrate, on top of an object optionally provided with a receptive layer; pressing the assembly between a heating device, such as a thermal head, and a platen roll; and selectively heating the heating device in its heating portion according to image information to transfer the colorant contained in the colorant layer on the thermal transfer film onto the object, whereby an image is recorded on the object. Thermal transfer methods are roughly classified into thermal ink transfer (hot melt-type thermal transfer) and thermal dye sublimation transfer (sublimation-type thermal transfer)

The thermal ink transfer is a method for image formation wherein a thermal transfer film bearing thereon a heat-fusion ink layer is heated by the above heating means and the component of the softened heat-fusion ink layer is transferred onto an object such as natural fiber paper or plastic sheet to form an image. The heat-fusion ink layer used herein is formed of a dispersion of a colorant, such as a pigment, in a binder, such as heat-fusion wax or resin and is supported on a substrate such as a plastic film. The formed image has high density and high sharpness, and this method is suitable for recording binary images of characters, line drawings and the like.

On the other hand, the thermal dye sublimation transfer is a method for image formation wherein a thermal transfer film bearing thereon a sublimable dye layer is heated by the above heating means to sublimate and transfer the sublimable dye contained in the dye layer onto a receptive layer provided on an object, whereby an image is formed on the object. The sublimable dye layer used herein is formed of a solution or dispersion of a sublimable dye used as the colorant in a binder resin and is supported on a substrate film such as a plastic film. According to this method, since the amount of the dye transferred can be regulated dot by dot according to the quantity of energy applied to a heating device, such as a thermal head, the reproduction of gradation can be realized by varying the density.

Thus, the thermal ink transfer method and the thermal dye sublimation transfer method have respective features, that is, the thermal ink transfer method can easily and clearly form images of characters, numerals and the like, while the thermal dye sublimation transfer method is excellent in gradation rendering and can form images such as a photograph-like image of a face in a faithful, clear manner.

Images formed by the thermal ink transfer method, however, disadvantageously suffer from poor fastness or resistance properties, particularly poor abrasion resistance. On the other hand, images formed by the thermal dye sublimation method, unlike images using conventional printing ink, are free from any vehicle and thus are disadvantageously poor in fastness or resistance properties such as lightfastness, weathering resistance, abrasion resistance, and chemical resistance.

To overcome the above problems, for example, Japanese Patent Laid-Open No. 11674/1997 proposes the transfer of a protective layer onto information of a thermally transferred image to impart fastness or resistance properties to the image.

In the transfer of the protective layer, the protective layer should be evenly and accurately transferred in a specified size onto a specified position. To this end, in order to improve the sensitivity in the transfer of the protective layer, the glass transition temperature and the heat softening temperature of the resin constituting the protective layer are set to respective relatively low temperatures. As a result, the storage stability of the protective layer transferred sheet is deteriorated, and this poses problems including that blocking is likely to occur during storage of the protective layer transferred sheet in a roll form.

SUMMARY OF THE INVENTION

The present invention has been made with a view to solving the above problems of the prior art, and it is an object of the present invention to provide a thermal transfer film which can yield an image formed object possessing excellent fastness or resistance properties such as excellent abrasion resistance and lightfastness, has good sensitivity in transfer, and is free from blocking during storage in a roll form, a thermal transfer recording medium, and a method for image formation using them.

The above object can be attained by a thermal transfer film comprising: a substrate; and one or a plurality of layers provided on one side of the substrate, said one or plurality of layers including at least a thermal transfer layer, the thermal transfer layer being located on the uppermost surface of the thermal transfer film, the thermal transfer layer comprising at least two polyester resins different from each other in number average molecular weight.

At least one of the polyester resins preferably has a number average molecular weight of 1000 to 10000, or alternatively, at least one of the polyester resins preferably has a number average molecular weight of 10000 to 30000.

More preferably, one of the polyester resins has a number average molecular weight of 1000 to 10000 and another polyester resin has a number average molecular weight of 10000 to 30000. The combination of the low-molecular weight polyester resin with the high-molecular weight polyester resin can realize a combination of good transferability at the time of thermal transfer with good fastness or resistance properties, such as good abrasion resistance and lightfastness, of an image formed object after the transfer.

When the polyester resin having a number average molecular weight of 1000 to 10000 is used, preferably, the polyester resin has a glass transition temperature of 50 to 100° C. The use of this polyester resin can prevent blocking and can realize good transferability.

According to a preferred embodiment of the present invention, the polyester resins comprise, as acid components as monomers constituting the polyester resins, terephthalic acid, isophthalic acid, and trimellitic acid. Further, according to another preferred embodiment of the present invention, the polyester resins comprise, as alcohol components as monomers constituting the polyester resins, at least two members selected from the group comprising tricyclodecane glycol, neopentyl glycol, and ethylene glycol.

The use of polyester resins comprising these monomer components can yield an image formed object, provided with a protective layer formed by the transfer of the thermal transfer layer, possessing excellent fastness or resistance properties, such as excellent abrasion resistance and lightfastness, can provide a thermal transfer film having excellent transferability and fixation, and facilitates the regulation of the glass transition temperature of the polyester resin to 50 to 100° C.

According to a preferred embodiment of the present invention, the thermal transfer layer contains 0.5 to 10% by weight of a lubricant. More preferably, the lubricant is a wax having a melting point of 70° C. or above. The presence of this lubricant can improve the abrasion resistance, gloss and the like of the image formed object, onto which the thermal transfer layer has been transferred, and the transferability of the transfer layer.

According to an embodiment of the present invention, a release layer is provided between the substrate and the thermal transfer layer so as not to be separable from the substrate side. This construction can improve the transferability of the thermal transfer layer.

According to a preferred embodiment of the present invention, a peel layer is provided between the substrate and the thermal transfer layer so as to be separable from the substrate side. According to this construction, the thermal transfer layer, together with the peel layer, can be easily transferred onto the object.

More preferably, the peel layer is provided between the release layer and the thermal transfer layer so as to be separable from the release layer. According to this construction, the thermal transfer layer, together with the peel layer, can be easily transferred onto the object.

The release layer preferably consists essentially of at least one or more resin selected from the group comprising polyvinyl acetal, polyvinylbutyral, and polyvinyl alcohol. This can further improve the transferability of the thermal transfer layer.

More preferably, the peel layer consists essentially of a homo- or copolymer of a methacrylate base monomer. This construction can further improve the fastness or resistance properties, such as abrasion resistance and lightfastness, of the image formed object onto which the thermal transfer layer and the peel layer have been transferred.

According to the present invention, there is provided a method for image formation, comprising the steps of: putting the above thermal transfer film on top of the above thermal transfer recording medium comprising, a substrate and, provided on at least one side of the substrate, a thermal transfer ink layer comprising a thermoplastic resin and a colorant, so that the thermal transfer layer faces the thermal transfer ink layer; imagewise heating the stacked thermal transfer recording medium to imagewise transfer the thermal transfer ink layer or the colorant onto the thermal transfer layer in the thermal transfer film, whereby a reverse image is once formed on the thermal transfer film; then putting the image formed thermal transfer film on top of an object so that the thermal transfer layer in the thermal transfer film faces the object in its image forming face; and heating the stacked thermal transfer film from its surface remote from the thermal transfer layer, whereby the image formed thermal transfer layer is transferred onto the object to form an image on the object.

According to this construction, in the image formed object, the thermally transferred image is protected by the thermal transfer layer and thus is excellent in fastness or resistance properties, such as abrasion resistance and lightfastness, and the image-formed thermal transfer layer can be transferred onto an object by single transfer using a thermal transfer film which can function as an intermediate transfer recording medium. Therefore, no significant damage to the object by the transfer occurs, and a deterioration in quality of the image formed object can be suppressed.

According to a further aspect of the present invention, there is provided a method for image formation, comprising the steps of: forming an image on an object by a thermal ink transfer method, a thermal dye sublimation method, an electrophotographic method, or an ink jet recording method; then putting the object with an image formed thereon on the top of the thermal transfer film so that the image formed face in the object faces the thermal transfer layer in the thermal transfer film; and heating the stacked thermal transfer film from its surface remote from the thermal transfer layer, whereby the thermal transfer layer is transferred onto the object with an image formed thereon. According to this construction, in the image formed object, the image formed by a thermal ink transfer method, a thermal dye sublimation method, an electrophotographic method, or an ink jet recording method is covered and protected by the thermal transfer layer and thus is excellent in fastness or resistance properties such as abrasion resistance and lightfastness.

The image formed object according to the present invention comprises an image formed by the above method for image formation.

The thermal transfer recording medium according to the present invention used in the above method for image formation is a thermal transfer recording medium comprising a substrate and, provided on at least one side of the substrate, a thermal transfer ink layer containing a thermoplastic resin and a colorant, the thermoplastic resin comprising a polyester resin. According to this construction, the compatibility between the thermal transfer layer in the thermal transfer film and the thermal transfer ink layer in the thermal transfer recording medium is so high that the fixation of the thermal transfer ink layer transferred onto the thermal transfer layer is enhanced. By virtue of this, the resultant image formed object is excellent in fastness or resistance properties such as abrasion resistance and lightfastness.

According to a preferred embodiment of the present invention, the polyester resin has a glass transition temperature of 50 to 100° C. and a number average molecular weight of 1000 to 10000. The use of this polyester resin can offer excellent effects, for example, can improve the fastness or resistance properties of the image formed object, the sensitivity in transfer, and antiblocking properties during storage in a roll form.

More preferably, the polyester resin comprises, as acid components as monomers constituting the polyester resin, terephthalic acid, isophthalic acid, and trimellitic acid, and comprises, as alcohol components as monomers constituting the polyester resin, at least two members selected from the group consisting of tricyclodecane glycol, neopentyl glycol, and ethylene glycol. The use of these monomer components can yield an image formed object, wherein the protective layer derived from the thermal transfer layer can provide excellent fastness or resistance properties, such as excellent abrasion resistance and lightfastness. This further can provide excellent transferability and fixation of the transfer layer and facilitates the regulation of the glass transition temperature of the polyester resin to 50 to 100° C.

DETAILED DESCRIPTION OF THE INVENTION

The present invention will be described in more detail with reference to preferred embodiments.

Figure 1:
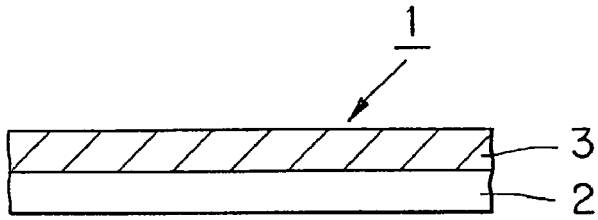
FIG. 1 is a cross-sectional view showing one embodiment of the thermal transfer film 1 according to the present invention.

FIG. 1 is a cross-sectional view showing one embodiment of a thermal transfer film 1 according to the present invention. In the thermal transfer film 1, a thermal transfer layer 3 is provided on a substrate 2. The thermal transfer layer 3 is located at a position most remote from the substrate 2, that is, located on the uppermost surface of the thermal transfer film 1. This thermal transfer film 1 is put on top of an object so that the thermal transfer layer 3 comes into contact with and faces the object. In this state, the assembly is heated from the backside of the substrate 2 by means of a thermal head, a laser beam or the like to transfer the thermal transfer layer 3 onto the object.

Figure 2:
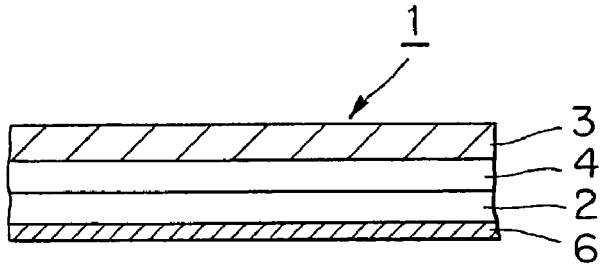
FIG. 2 is a cross-sectional view showing another embodiment of the thermal transfer film 1 according to the present invention.

FIG. 2 is a cross-sectional view illustrating another embodiment of a thermal transfer film 1 according to the present invention. In the thermal transfer film 1, a release layer 4 and a thermal transfer layer 3 are stacked in that order on a substrate 2. The thermal transfer layer 3 is located at a position most remote from the substrate 2. A backside layer 6 is provided on the substrate 2 in its surface remote from the thermal transfer layer 3. In the case of the thermal transfer film shown in FIG. 2, the thermal transfer film 1 is put on top of an object so that the thermal transfer layer 3 comes into contact with and faces the object. In this state, the assembly is heated from the backside layer 6 side by means of a thermal head, a laser beam or the like to transfer the thermal transfer layer 3 onto the object. In this case, the release layer 4 is left on the substrate 2 side.

Figure 3:
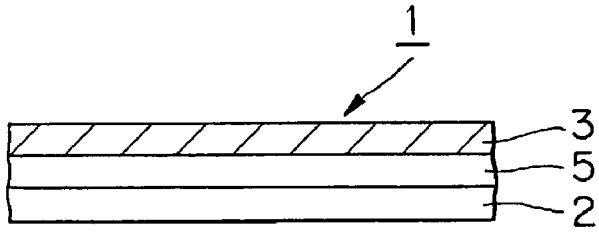
FIG. 3 is a cross-sectional view showing still another embodiment of the thermal transfer film 1 according to the present invention.

FIG. 3 is a cross-sectional view illustrating another embodiment of a thermal transfer film 1 according to the present invention. In the thermal transfer film 1, a peel layer 5 and a thermal transfer layer 3 are stacked in that order on a substrate 2. The thermal transfer layer 3 is located at a position most remote from the substrate 2, that is, is located on the uppermost surface of the thermal transfer film 1. In the case of the thermal transfer film shown in FIG. 3, the thermal transfer film 1 is put on top of an object so that the thermal transfer layer 3 comes into contact with and faces the object. In this state, the assembly is heated from the backside of the substrate 2 by means of a thermal head, a laser beam or the like to transfer the peel layer 5 and the thermal transfer layer 3 onto the object.

Figure 4:
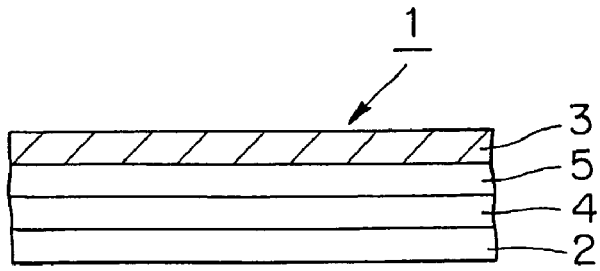
FIG. 4 is a cross-sectional view showing a further embodiment of the thermal transfer film 1 according to the present invention.

FIG. 4 is a cross-sectional view illustrating a further embodiment of a thermal transfer film 1 according to the present invention. In the thermal transfer film 1, a release layer 4, a peel layer 5, and a thermal transfer layer 3 are stacked in that order on a substrate 2. The thermal transfer layer 3 is located at a position most remote from the substrate 2, that is, is located on the uppermost surface of the thermal transfer film 1. In the case of the thermal transfer film shown in FIG. 4, the thermal transfer film 1 is put on top of an object so that the thermal transfer layer 3 comes into contact with and faces the object. In this state, the assembly is heated from the backside of the substrate 2 by means of a thermal head, a laser beam or the like to transfer the peel layer 5 and the thermal transfer layer 3 onto the object. In this case, the release layer 4 is left on the substrate 2 side.

The thermal transfer recording medium according to the present invention comprises a substrate and, provided on at least one side of the substrate, a thermal transfer ink layer containing a thermoplastic resin and a colorant. The thermal transfer recording medium is used in combination with the thermal transfer film to form an image.

One embodiment of the method for image formation is schematically shown in FIGS. 5 to 8. A thermal transfer film 1 comprising a substrate 21 and a thermal transfer layer 3 provided on one side of the substrate 21, that is, a thermal transfer film 1 wherein a thermal transfer layer 3 is provided, on one side of a substrate 21, at a position most remote from the substrate 21, is put on top of a thermal transfer recording medium 7 comprising a substrate 22 and, provided on at least one side of the substrate 22, a thermal transfer ink layer 8 containing a thermoplastic resin and a colorant so that the thermal transfer layer 3 in the thermal transfer film 1 faces the thermal transfer ink layer 8 in the thermal transfer recording medium 7. The assembly is heated imagewise. In this case, the heating is carried out by means of a thermal head 11. Specifically, the thermal transfer film 1 and the thermal transfer recording medium 7 are sandwiched between the thermal head 11 and a platen roll 12, and, in this embodiment, the assembly is imagewise heated by means of the thermal head 11 from the thermal transfer recording medium 7 remote from the thermal transfer ink layer 8 (see FIG. 5).

After the heating, the stacked thermal transfer film 1 and thermal transfer recording medium 7 are separated from each other to transfer, as an image 9, the thermal transfer ink layer 8 or the colorant contained in the thermal transfer ink layer 8 in the thermal transfer recording medium 7 onto the thermal transfer layer 3 in the thermal transfer film 1. This image 9 is a reverse image (a mirror image) as viewed in a direction indicated by A and is a non-reverse image as viewed from a direction indicated by B (see FIG. 6).

Next, the thermal transfer film 1 with the image 9 formed thereon is put on top of an object 10 so that the thermal transfer layer 3 in the thermal transfer film 1 faces the image forming face of the object 10. The assembly is heated by means of a heat roll 13 as a heat source from the thermal transfer film 1 in its side remote from the thermal transfer layer 3. In the heating by means of the heat roll 13, the thermal transfer film 1 and the object 10 are sandwiched, heated and pressed between the heat roll 13 and the platen roll 12 (see FIG. 7).

Figure 8:
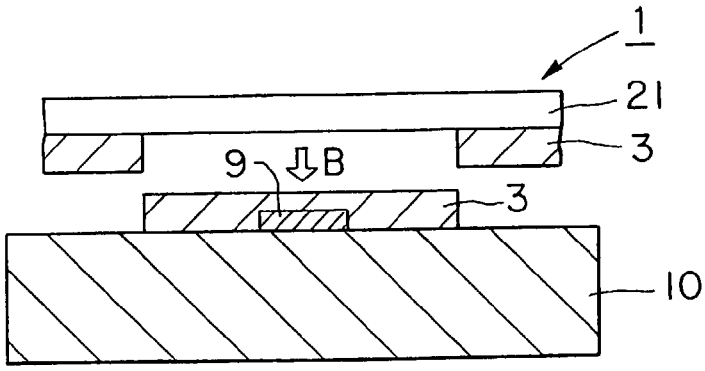
FIG. 8 is a schematic view illustrating an embodiment of the method for image formation according to the present invention.

After the heating, the stacked thermal transfer film 1 and object 10 are separated from each other, whereby the image 9 and the thermal transfer layer 3 in the thermal transfer film 1 in its portion, heated by the heat roll 13, are transferred onto the object 10 (see FIG. 8).

The thermal transfer recording medium 7 used in the above method for image formation comprises a substrate 22 and, provided on the substrate 22, a heat-fusion ink layer or a sublimable dye ink layer as a thermal transfer ink layer 8. In this case, any of the heat-fusion ink layer and the sublimable dye ink layer may be selected. In the case of the thermal transfer recording medium comprising a heat-fusion ink layer provided on a substrate, upon printing, the heat-fusion ink layer is transferred onto the object.

On the other hand, in the case of the thermal transfer recording medium comprising a sublimable dye ink layer provided on a substrate, upon printing, the sublimable dye as the colorant contained in the sublimable dye ink layer is transferred onto the object.

The thermal transfer recording medium is not limited, and the thermal transfer ink layer may be any conventional thermal transfer ink layer such as a heat-fusion ink layer or a sublimable dye ink layer.

At the outset, the layers and the like constituting the thermal transfer film according to the present invention will be described in detail.

Substrate

The same substrate as used in the conventional thermal transfer film as such may be used as the substrate 2 in the thermal transfer film according to the present invention. Further, substrates having a surface subjected to easy-adhesion treatment and the like may also be adopted without particular limitation. Specific examples of preferred substrates include: films of plastics including polyethylene terephthalate and, further, polyesters, polycarbonates, polyamides, polyimides, cellulose acetate, polyvinylidene chloride, polyvinyl chloride, polystyrene, fluororesin, polypropylene, polyethylene, and ionomers; papers such as glassine paper, capacitor paper, and paraffin-waxed paper; and cellophane. Further, a composite film produced by stacking two or more of them on top of each other or one another may also be used. The thickness of the substrate 2 may properly vary depending upon materials so that the substrate has proper strength and heat resistance. In general, however, the thickness of the substrate 2 is preferably about 2 to 100 $\mu$m.

Thermal Transfer Layer

In the thermal transfer film according to the present invention, the thermal transfer layer 3 provided on the substrate is provided at a position most remote from the substrate. A thermally transferred image formed on the thermal transfer layer is transferred, together with the thermal transfer layer, onto an object, whereby the image is protected by the thermal transfer layer after the transfer. Alternatively, the thermal transfer layer is transferred onto an image (a thermally transferred image or the like) formed on an object and, after the transfer, can function as a protective layer for the image. The protective layer can contribute to fastness or resistance properties, such as abrasion resistance and lightfastness, of the image.

The thermal transfer layer after the transfer has excellent abrasion resistance, transparency, hardness or other properties and, in addition, has good sensitivity in transfer and can prevent blocking during storage of the thermal transfer film in a roll form. This is derived from the provision of a thermal transfer layer, containing two or more polyester resins different from each other or one another in number average molecular weight, on one side of the substrate, at a position most remote from the substrate.

At least one of the polyester resins preferably has a number average molecular weight of 1000 to 10000.

Alternatively, at least one of the polyester resins preferably has a number average molecular weight of 10000 to 30000.

Regarding the polyester resins constituting the thermal transfer layer, preferably, at least one of the polyester resins has a number average molecular weight of 1000 to 10000, and another polyester resin has a number average molecular weight of 10000 to 30000.

The number average molecular weight specified in the present invention may be measured by gel permeation chromatography (GPC). The above-defined number average molecular weight range, when expressed in the range of A to B, refers to that the number average molecular weight is not less than A and less than B.

Preferably, the thermal transfer layer is formed of a combination of at least one relatively low-molecular weight polyester resin having a number average molecular weight of not less than 1000 and less than 10000 with at least one relatively high-molecular weight polyester resin having a number average molecular weight of not less than 10000 and less than 30000.

The thermal transfer layer containing a relatively low-molecular weight polyester resin having a number average molecular weight of not less than 1000 and less than 10000 has a relatively low glass transition temperature or softening point and can provide good sensitivity in thermal transfer.

The thermal transfer layer containing a relatively high-molecular weight polyester resin having a number average molecular weight of not less than 10000 and less than 30000 has a relatively high glass transition temperature or softening point, has excellent heat resistance and other properties, and effectively functions to prevent blocking during storage of the thermal transfer film in a roll form.

Accordingly, the use of a combination of at least one relatively low-molecular weight polyester resin with at least one relatively high-molecular weight polyester resin in the thermal transfer layer can realize simultaneous utilization of the above-described function of the low-molecular weight polyester resin and the above-described function of the high-molecular weight polyester resin.

When the relatively high-molecular weight polyester resin is not contained, the polyester resin having a number average molecular weight of 1000 to 10000 preferably has a glass transition temperature of 50 to 100° C. When the glass transition temperature is below 50° C., blocking is likely to occur during storage of the thermal transfer film in a roll form. On the other hand, when the glass transition temperature is above 100° C., the transferability is deteriorated.

The thermal transfer layer may comprise, in addition to the above polyester resins, a vinyl chloride-vinyl acetate copolymer, a polystyrene resin, an acrylic resin, a polyurethane resin, an acrylated urethane resin, a silicone modification product of these resins, a polycarbonate resin or the like. The resin other than the polyester resins used in the thermal transfer layer is preferably a thermoplastic resin having a glass transition temperature of about 50 to 120° C.

In the polyester resins, examples of aromatic acids usable as the acid component include terephthalic acid, isophthalic acid, o-phthalic acid, and 2,6-naphthalenedicarboxylic acid, and examples of aliphatic or alicyclic dicarboxylic acids usable as the acid component include succinic acid, adipic acid, azelaic acid, sebacic acid, dodecanedioic acid, dimmer acid, tetrahydrophthalic acid, hexahydrophthalic acid, hexahydroisophthalic acid, and hexahydroterephthalic acid. Tri- or higher functional polycarboxylic acids, such as trimellitic acid and pyromellitic acid, may also be used.

In the thermal transfer film according to the present invention, preferably, the thermal transfer layer is formed of a polyester resin particularly using terephthalic acid, isophthalic acid, and trimellitic acid as constituent monomers of the acid component. In this case, upon transfer onto the object, the thermal transfer layer functions as a protective layer which can impart excellent fastness or resistance properties such as excellent abrasion resistance and lightfastness.

Examples of the alcohol component as another component of the polyester resin include ethylene glycol, 1,2-propylene glycol, 1,3-propanediol, 1,4-butanediol, neopentyl glycol, 1,5-pentanediol, 1,6-hexanediol, 1,4-cyclohexanedimethanol, and tricyclodecane glycol. From the viewpoints of fastness or resistance properties, such as abrasion resistance and lightfastness, transferability, fixation and the like as the protective layer, a polyester resin particularly using at least two members selected from tricyclodecane glycol, neopentyl glycol, and ethylene glycol as constituent monomers are preferred because a polyester resin having a glass transition temperature of 50 to 100° C. and a number average molecular weight of 1000 to 10000 or a polyester resin having a number average molecular weight of 10000 to 30000 can be easily produced.

The thermal transfer layer in the thermal transfer film according to the present invention may further comprise a lubricant from the viewpoint of improving the abrasion resistance of an image formed object after the transfer of the thermal transfer layer onto the object. Lubricants include waxes and surfactants. Specific examples of waxes include: naturally occurring waxes, such as beeswax, spermaceti, Japan wax, rice brain wax, carnauba wax, candelilla wax, and montan wax; and synthetic waxes, such as paraffin wax, microcrystalline wax, oxidized wax, ozokerite, ceresin, ester wax, and polyethylene wax. In particular, a wax having a melting point of 70° C. or above is preferred because blocking is less likely to occur during the storage of the thermal transfer film in a roll form or during the storage of the image formed object.

Surfactants as the lubricant include phosphoric acid-based surfactants and fluorine-based surfactants. Further lubricants include higher aliphatic alcohols and organopolysiloxanes.

This lubricant is preferably contained in an amount of 0.5 to 10% by weight based on the thermal transfer layer in a dry state. When the content of the lubricant is below the lower limit of the above-defined content range, satisfactory abrasion resistance cannot be imparted. On the other hand, the content of the lubricant is above the upper limit of the above-defined content range, problems occur such as lowered adhesion of the thermal transfer layer to the object.

The thermal transfer layer may be formed by adding necessary additives to the resin for a thermal transfer layer, dissolving the mixture in a suitable organic solvent or dispersing the mixture in an organic solvent or water, coating the solution or dispersion onto a substrate, for example, by forming means, such as gravure coating, gravure reverse coating, or roll coating, and drying the coating. The thickness of the thermal transfer layer may be any value. Preferably, however, the thickness of the thermal transfer layer is 0.1 to 50 g/m$^2$, more preferably 0.2 to 10 g/m$^2$, on a dry basis.

In the thermal transfer film according to the present invention, a thermal transfer layer is provided separably on a substrate. In this case, the thermal transfer layer may be provided on the substrate through a release layer from the viewpoint of further facilitating the separation of the thermal transfer layer from the substrate upon heating. At the time of thermal transfer, this release layer is not separated from the substrate but is left on the substrate side.

Release Layer

In the thermal transfer film, in some combination of the material for the substrate with the material for the thermal transfer layer, the separation at the time of the thermal transfer is unsatisfactory. In this case, a release layer 4 may be previously provided on the substrate. The release layer may be formed of a polyvinyl acetal resin, a polyvinyl butyral resin, a polyvinyl alcohol resin, a silicone resin, a fluororesin, an acrylic resin, a urethane resin, a cellulosic resin such as cellulose acetate, waxes, silicone wax or the like.

The release layer is preferably composed mainly of at least one resin selected from polyvinyl acetal, polyvinyl butyral, and polyvinyl alcohol from the viewpoint of further improving the transferability of the thermal transfer layer.

The release layer may be formed by coating a coating liquid containing the components constituting the release layer by a conventional method, such as gravure coating or gravure reverse coating, and drying the coating. A coverage of the coating of about 0.01 to 2 g/m$^2$ suffices for the release layer. In selecting the material for the release layer, attention should be paid to proper separation of the release layer from the thermal transfer layer, as well as to the satisfaction of a requirement that the adhesion between the release layer and the substrate is larger than the adhesion between the release layer and the thermal transfer layer. Unsatisfactory adhesion between the release layer and the substrate is causative of abnormal transfer such as transfer of the release layer together with the thermal transfer layer. When a matte surface appearance is desired in the print after the transfer of the transfer layer, the surface of the print after the transfer of the thermal transfer layer can be rendered matte by incorporating various particles into the release layer or by using a substrate of which the surface on the release layer side has been rendered matte.

In the thermal transfer film according to the present invention, the thermal transfer layer is provided separably on the substrate. The thermal transfer layer may be provided on the substrate through a peel layer. In this case, upon heating, the thermal transfer layer can be more easily separated from the substrate. This peel layer is separable from the substrate at the time of thermal transfer.

Peel Layer

The peel layer 5 may comprise an acrylic resin, a polyvinyl alcohol resin, a polyvinyl acetal resin, a polyvinyl butyral resin, a vinyl chloride-vinyl acetate copolymer, a chlorinated polyolefin, a silicone resin, a fluororesin, a cellulose derivative resin or the like, a copolymer of a group of these resins, waxes, silicone wax or the like.

The peel layer is preferably composed mainly of a homo- or copolymer of a methacrylate monomer which can further improve fastness or resistance properties, such as abrasion resistance, of the image formed object onto which the thermal transfer layer and the peel layer have been transferred.

Methacrylate monomers usable herein include, for example, methyl methacrylate, ethyl methacrylate, n-propyl methacrylate, i-propyl methacrylate, n-butyl methacrylate, i-butyl methacrylate, sec-butyl methacrylate, cyclohexyl methacrylate, benzyl methacrylate, 2-ethylhexyl methacrylate, 2-hydroxyethyl methacrylate, and 2-hydroxypropyl methacrylate.

The peel layer may be formed by coating a coating liquid containing the components constituting the peel layer by conventional forming means, such as gravure printing, screen printing, or reverse roll coating using a gravure plate, and drying the coating. The coverage of the peel layer is about 0.01 to 5 g/m$^2$ on a dry basis.

In the thermal transfer film, an adhesive layer may be provided on the thermal transfer layer provided on the substrate to improve the fixation of the thermal transfer layer to the object at the time of thermal transfer. A material, which develops adhesion upon heating, is preferably selected for the adhesive layer. For example, the adhesive layer may be formed using thermoplastic synthetic resin, naturally occurring resin, rubber, waxes or the like in the same manner as used in the formation of the peel layer. The coverage of the adhesive layer is about 0.01 to 5 g/m$^2$.

Backside Layer

In the thermal transfer film, a backside layer 6 may be provided on the substrate in its side remote from the thermal transfer layer from the viewpoints of preventing blocking between the thermal transfer film and a thermal head or the like and, at the same time, improving slipperiness.

The backside layer may be formed of a single resin or a mixture of two or more resins selected from naturally occurring or synthetic resins, for example, cellulosic resins, such as ethylcellulose, hydroxycellulose, hydroxypropylcellulose, methylcellulose, cellulose acetate, cellulose acetate butyrate and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyamide resin, polyvinyltoluene resin, coumarone-indene resin, polyester resin, polyurethane resin, and silicone-modified or fluorine-modified urethane. In order to further enhance the heat resistance of the backside layer, preferably, among the above resins, a resin containing a reactive group based on a hydroxyl group is used in combination with polyisocyanate or the like as a crosslinking agent to form a crosslinked resin layer as the backside layer.

In order to impart slidability against the thermal head, a solid or liquid release agent or lubricant may be added to the backside layer to impart heat-resistant slipperiness to the backside layer. Release agents or lubricants include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, organic carboxylic acids and derivatives thereof, fluororesin, silicone resin, and fine particles of inorganic compounds such as talc, and silica. The content of the lubricant in the backside layer is about 5 to 50% by weight, preferably about 10 to 30% by weight.

The backside layer may be formed by dissolving or dispersing the above resin, optionally together with a release agent, a lubricant and the like, in a suitable solvent to prepare a coating liquid, coating the coating liquid by a conventional coating method such as gravure coating, roll coating, or wire bar coating, and drying the coating. The coverage of the backside layer is about 0.1 to 10 g/m$^2$ on a dry basis.

The layers and the like constituting the thermal transfer recording medium will be described in detail.

The thermal transfer recording medium according to the present invention comprises a substrate and, provided on at least one side of the substrate, a thermal transfer ink layer comprising a polyester resin as a thermoplastic resin and a colorant.

Substrate

The substrate 22 used in the thermal transfer recording medium may be any substrate which has hitherto been used in conventional thermal transfer recording media so far as the substrate can support the thermal transfer ink layer and has strength and heat resistance. Specifically, the same materials as described above in connection with the substrate in the thermal transfer film may be used in the substrate 22.

The thickness of the substrate may be properly selected depending upon materials so that the strength, heat resistance and other properties of the substrate are proper. In general, however, the thickness of the substrate is preferably about 1 to 50 $\mu$m.

Thermal Transfer Ink Layer

The thermal transfer ink layer 8 provided on the substrate may be formed using a coating liquid containing a thermoplastic resin, composed mainly of a polyester resin, and a colorant and optionally additives, for example, lubricants such as waxes, dispersants, and anti-settling agents.

Various conventional colorants may be used as the colorant. Among organic or inorganic pigments or dyes, those having good properties as a recording material, for example, those, which have satisfactory color density and are less likely to cause color change and fading upon exposure, for example, to light, heat, and temperature, are preferred as the colorant. Colorants having cyan, magenta, yellow, black and other hues may be properly selected. Pigments having a metallic luster, such as gold color, silver color, or copper color, fluorescent inorganic or organic pigments or dyes, and pigments or dyes of white or intermediate colors such as green, orange, and purple, may also be used.

Among metallic pigments such as gold, silver, copper, zinc, aluminum, chromium and other metal or alloy powders, an aluminum pigment is preferably used because excellent metallic luster and opacifying effect can be realized independently of, for example, the color of the ground of the transfer face of the object. The aluminum pigment may be in a spherical form or a form similar to spheres. However, a platy aluminum pigment is preferred because excellent metallic luster and opacifying effect can be provided. Aluminum used in the thermal transfer layer preferably has an average length of about 1 to 20 $\mu$m and an average thickness of about 0.01 to 5 $\mu$m because the dispersibility in the coating liquid and the metallic luster of the formed image are excellent.

The thermal transfer recording medium according to the present invention comprises a substrate and a thermal transfer ink layer provided on one side of the substrate. Thermal transfer ink layers usable herein are roughly classified into two types, heat-fusion ink layers or sublimable dye ink layers. The heat-fusion ink layer comprises conventional colorant and binder and optionally various additives, for example, mineral oils, vegetable oils, higher fatty acids such as stearic acid, plasticizers, and fillers. The resin component used as the binder is composed mainly of a polyester resin and optionally further comprises ethylene-vinyl acetate copolymer, ethylene-acrylic ester copolymer, polyethylene, polystyrene, polypropylene, polybutene, petroleum resin, vinyl chloride resin, vinyl chloride-vinyl acetate copolymer, polyvinyl alcohol, vinylidene chloride resin, methacrylic resin, polyamide, polycarbonate, fluororesin, polyvinylformal, polyvinyl butyral, acetylcellulose, nitrocellulose, polyvinyl acetate, polyisobutylene, ethylcellulose, polyacetal or the like.

A wax component may be added as the binder, and examples thereof include various waxes, for example, microcrystalline wax, carnauba wax, and paraffin wax. Further, other various waxes such as Fischer-Tropsh wax, various types of low-molecular weight polyethylene, Japan wax, beeswax, spermaceti, insect wax, wool wax, shellac wax, candelilla wax, petrolactum, polyester wax, partially modified wax, fatty esters, and fatty amides may also be used.

In the present invention, the thermoplastic resin as the binder contained in the heat-fusion ink layer is composed mainly of a polyester resin, and the binder resin in the thermal transfer layer, onto which the ink layer is transferred, is composed mainly of a polyester resin. The polyesters resins similar to each other in structure are highly compatible with each other, and, thus, transferability and fixation of the ink layer onto the thermal transfer layer are excellent.

The colorant may be properly selected from the above-described conventional organic or inorganic pigments or dyes. Further, a heat-conductive material may be incorporated as a filler for the binder from the viewpoint of imparting good heat conductivity and heat-fusion transferability to the heat-fusion ink layer. Such fillers include, for example, carbonaceous materials, such as carbon black, and metals and metal compounds such as aluminum, copper, tin oxide, and molybdenum disulfide.

The heat-fusion ink layer may be formed by providing a coating liquid for a heat-fusion ink layer, prepared by mixing the colorant component, the binder component composed mainly of a polyester resin, and optionally a solvent component, such as water or an organic solvent, and coating the coating liquid by a conventional method such as hot-melt coating, hot lacquer coating, gravure coating, gravure reverse coating, or roll coating. A formation method using an aqueous or nonaqueous emulsion coating liquid may also be used. The coverage of the heat-fusion ink layer should be determined so as to obtain a balance between necessary print density and heat sensitivity and is preferably in the range of about 0.1 to 30 g/m$^2$, more preferably about 1 to 20 g/m$^2$.

The sublimable dye ink layer as the thermal transfer ink layer is a layer comprising a sublimable dye supported by a binder resin. Dyes commonly used in conventional thermal transfer recording media may be effectively used in the present invention without particular limitation. The following dyes may be mentioned as several examples of preferred dyes. Specifically, MS Red G, Macrolex Red Vioret R, Ceres Red 7 B, Samaron Red HBSL, Resolin Red F 3 BS and the like may be mentioned as red dyes. Phorone Brilliant Yellow 6 GL, PTY-52, Macrolex Yellow 6 G and the like may be mentioned as yellow dyes. Kayaset Blue 714, Waxoline Blue AP-FW, Phorone Brilliant Blue S-R, MS Blue 100 and the like may be mentioned as blue dyes.

The binder resin (thermoplastic resin) for carrying the above sublimable dyes is composed mainly of a polyester resin and further optionally comprises a cellulosic resin such as ethylcellulose, hydroxyethylcellulose, ethylhydroxycellulose, hydroxypropylcellulose, methylcellulose, cellulose acetate, or cellulose acetate butyrate; or a vinyl resin such as polyvinyl alcohol, polyvinyl acetate, polyvinyl butyral, polyvinyl acetal, polyvinyl pyrrolidone, or polyacrylamide.

Further, in order to enhance the separability of the thermal transfer ink layer from the thermal transfer layer as the image receiving side at the time of the formation of a thermally transferred image, a graft copolymer having at least one releasable segment selected from a polysiloxane segment, a carbon fluoride segment, and a long-chain alkyl segment each graft bonded to the main chain of the polyester resin may be used as the binder resin for carrying the thermally transferable dye.

The use of a dyeable thermoplastic resin binder is required in the thermal transfer layer for receiving the dye in the sublimable dye ink layer. Further, if necessary, a release agent, such as a fluorosurfactant, a silicone oil and/or a cured product thereof, may be incorporated into the sublimable dye ink layer so that, upon heating at the time of the formation of an image, the sublimable dye ink layer and the thermal transfer layer can be smoothly separated from each other without heat fusing. Fluorosurfactants include Fluorad FC-430 and FC-431, manufactured by 3M. Silicone oils include various modified silicone oils and cured products thereof, as described in "Sirikohn Handobukku (Silicone Handbook)" published by The Nikkan Kogyo Shimbun, Ltd. The use of a fluorosurfactant and an uncured silicone oil is particularly preferred because they have high adhesion. It is a matter of course that the use of the graft copolymer having a releasable segment as the binder resin in the thermal transfer layer can eliminate the need to add any release agent and can realize high adhesion between the object and the image-formed thermal transfer layer and thus is preferred.

The sublimable dye ink layer may contain, in addition to the dye and the binder resin composed mainly of a polyester resin, optional various conventional additives. The sublimable dye ink layer may be formed by dissolving or dispersing the dye, the binder resin, and additives in a suitable solvent to prepare an ink and coating the ink onto the substrate by the same conventional coating method as described above in connection with the heat-fusion ink layer. The coverage of the sublimable dye ink layer is about 0.1 to 5.0 g/m$^2$, preferably about 0.4 to 2.0 g/m$^2$.

Backside Layer

In the thermal transfer recording medium, a backside layer may be provided on the substrate in its side remote from the thermal transfer ink layer from the viewpoints of preventing blocking between the thermal transfer recording medium and a thermal head and, at the same time, improving slipperiness. This backside layer may be formed of the same material as used in the formation of the backside layer which may be provided in the thermal transfer film.

In the thermal transfer recording medium provided with a heat-fusion ink layer as the thermal transfer ink layer used in the present invention, the thermal transfer ink layer is provided on the substrate. In this case, the thermal transfer ink layer may be provided on the substrate through a peel layer to further facilitate the separation of the thermal transfer ink layer from the substrate upon heating. Further, an adhesive layer, an intermediate layer or the like may be provided on the thermal transfer ink layer in the thermal transfer recording medium. On the other hand, in the case of the thermal transfer recording medium provided with a sublimable dye ink layer as the thermal transfer ink layer, the thermal transfer ink layer is provided on the substrate. In this case, an intermediate layer, such as a primer layer, may be provided between the substrate and the thermal transfer ink layer to enhance the adhesion between the substrate and the thermal transfer ink layer.

The same material and formation method as used in the peel layer and the adhesive layer in the thermal transfer film may be applied to the peel layer and the adhesive layer in the thermal transfer recording medium.

Method for Image Formation

Figure 5:
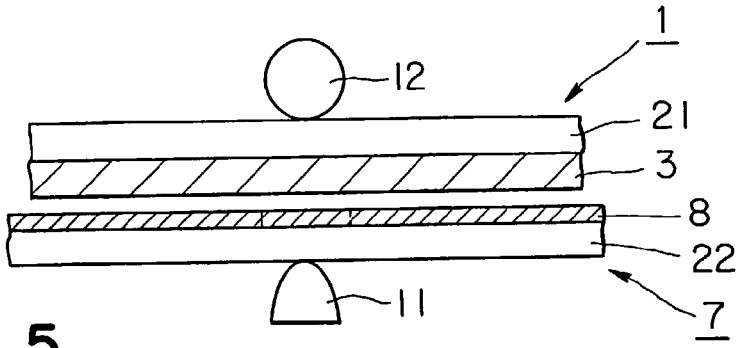
FIG. 5 is a schematic view illustrating an embodiment of the method for image formation according to the present invention.
Figure 6:
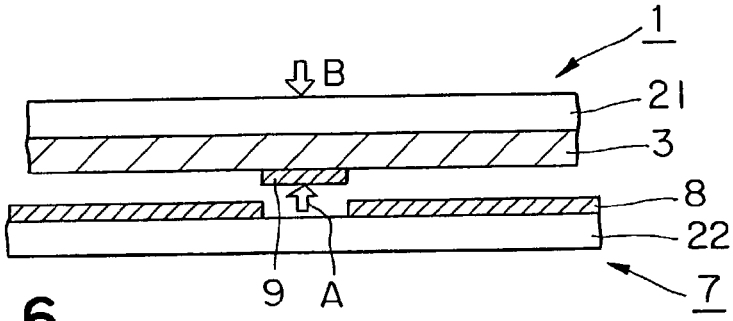
FIG. 6 is a schematic view illustrating an embodiment of the method for image formation according to the present invention.
Figure 7:
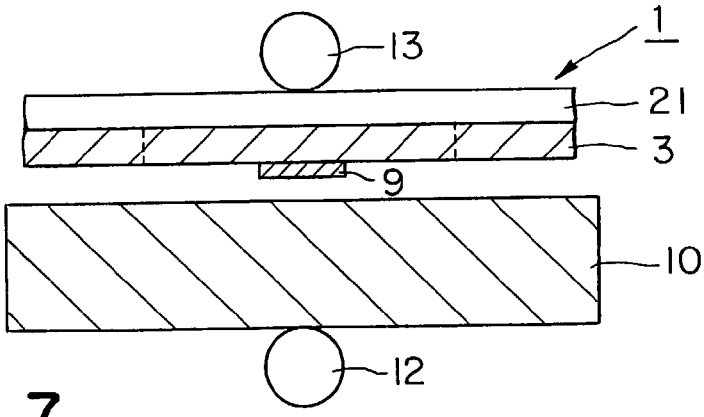
FIG. 7 is a schematic view illustrating an embodiment of the method for image formation according to the present invention.

FIG. 5 is a schematic view illustrating an embodiment of the method for image formation according to the present invention. A thermal transfer film 1 comprising a substrate 21 and a thermal transfer layer 3 provided on one side of the substrate 21, that is, a thermal transfer film 1 wherein a thermal transfer layer 3 is provided, on one side of a substrate 21, at a position most remote from the substrate 21, is put on top of a thermal transfer recording medium 7 comprising a substrate 22 and, provided on at least one side of the substrate 22, a thermal transfer ink layer 8 containing a thermoplastic resin and a colorant so that the thermal transfer layer 3 in the thermal transfer film 1 faces the thermal transfer ink layer 8 in the thermal transfer recording medium 7. The assembly is heated imagewise. In this case, the heating is carried out by means of a thermal head 11. Specifically, the thermal transfer film 1 and the thermal transfer recording medium 7 are sandwiched between the thermal head 11 and a platen roll 12, and, in this embodiment, the assembly is imagewise heated by means of the thermal head 11 from the thermal transfer recording medium 7 on its side remote from the thermal transfer ink layer 8 (see FIG. 5).

After the heating, the stacked thermal transfer film 1 and thermal transfer recording medium 7 are separated from each other to transfer, as an image 9, the thermal transfer ink layer 8 or the colorant contained in the thermal transfer ink layer 8 in the thermal transfer recording medium 7 onto the thermal transfer layer 3 in the thermal transfer film 1. This image 9 is a reverse image (a mirror image) as viewed in a direction indicated by A and is a non-reverse image as viewed from a direction indicated by B (see FIG. 6).

Next, the thermal transfer film 1 with the image 9 formed thereon is put on top of an object 10 so that the thermal transfer layer 3 in the thermal transfer film 1 faces the image forming face of the object 10. The assembly is heated by means of a heat roll 13 as a heat source from the thermal transfer film 1 in its side remote from the thermal transfer layer 3. In the heating by means of the heat roll 13, the thermal transfer film 1 and the object 10 are sandwiched, heated and pressed between the heat roll 13 and the platen roll 12 (see FIG. 7).

After the heating, the stacked thermal transfer film 1 and object 10 are separated from each other, whereby the image 9 and the thermal transfer layer 3 in the thermal transfer film 1 in its portion, heated by the heat roll 13, are transferred onto the object 10 (see FIG. 8).

The thermal transfer recording medium 7 used in the method for image formation according to the present invention comprises a substrate 22 and, provided on the substrate 22, a heat-fusion ink layer or a sublimable dye ink layer as a thermal transfer ink layer 8. In this case, any of the heat-fusion ink layer and the sublimable dye ink layer may be selected. In the case of the thermal transfer recording medium comprising a heat-fusion ink layer provided on a substrate, upon printing, the heat-fusion ink layer is transferred onto the object.

On the other hand, in the case of the thermal transfer recording medium comprising a sublimable dye ink layer provided on a substrate, upon printing, the sublimable dye as the colorant contained in the sublimable dye ink layer is transferred onto the object.

The thermal transfer recording medium is not limited, and the thermal transfer ink layer may be any conventional thermal transfer ink layer such as a heat-fusion ink layer or a sublimable dye ink layer.

Figure 9:
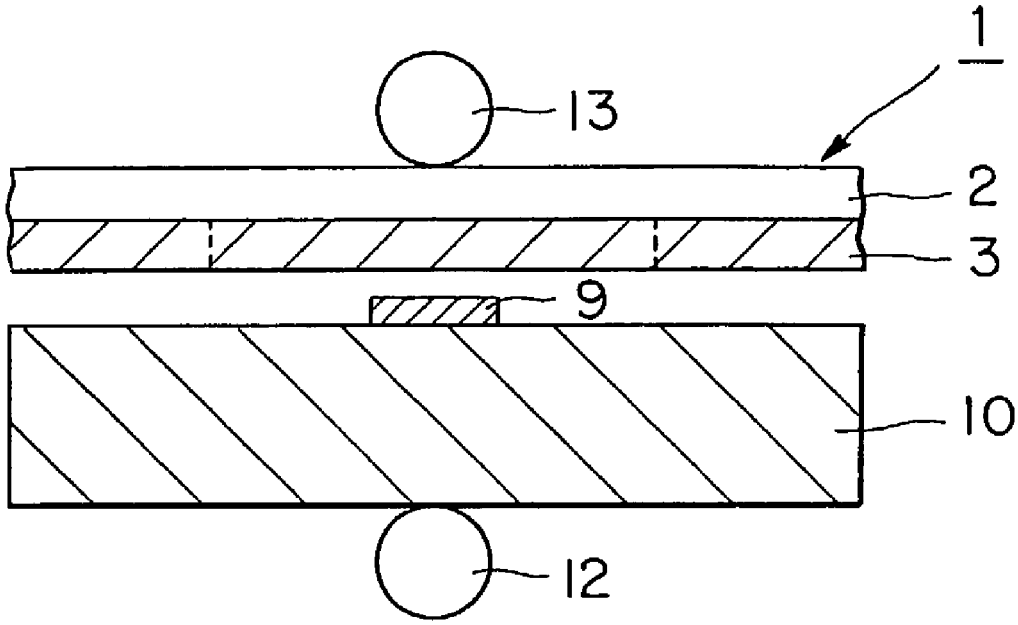
FIG. 9 is a schematic view illustrating another embodiment of the method for image formation according to the present invention.
Figure 10:
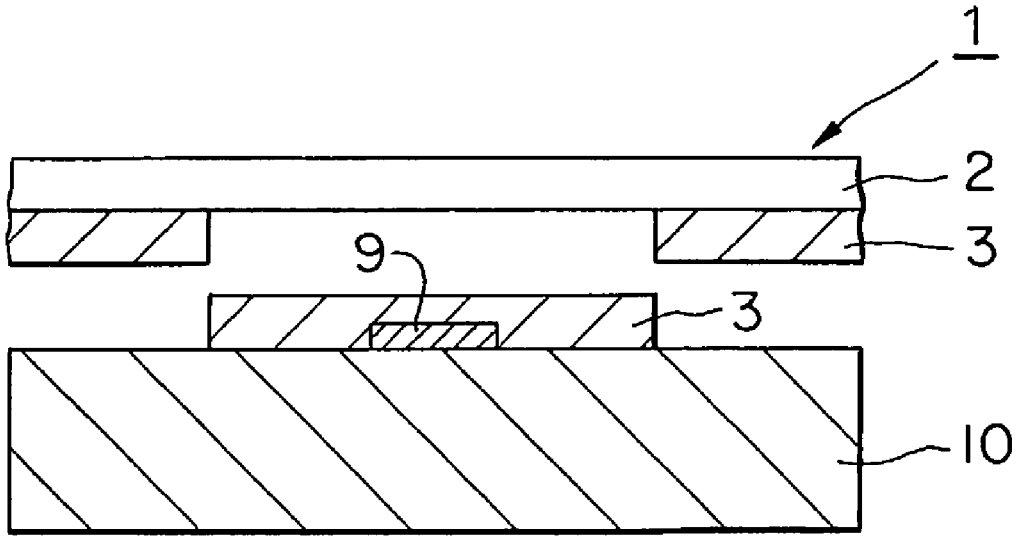
FIG. 10 is a schematic view illustrating a further embodiment of the method for image formation according to the present invention.

FIGS. 9 and 10 are schematic views illustrating another embodiment of the method for image formation according to the present invention. In the method for image formation according to this embodiment, an image 9 is formed on an object 10 by a thermal ink transfer method, a thermal sublimable dye transfer method, an elecrophotographic method, or an ink jet recording method. The object 10 with an image 9 formed thereon is put on top of a thermal transfer film 1 comprising a substrate 2 and, provided on one side of the substrate 2, a thermal transfer layer 3 at a position most remote from the substrate 2, so that the image formed face of the object 10 faces the thermal transfer layer 3. The assembly is heated by means of a heat roll 13 from the surface of the thermal transfer film 1 remote from the thermal transfer layer 3. In the heating by means of the heat roll 13, the thermal transfer film 1 and the object 10 with an image formed thereon are sandwiched, heated, and pressed between the heat roll 13 and a platen roll 12 (see FIG. 9).

After the heating, the stacked thermal transfer film 1 and object 10 are separated from each other, whereby, in the thermal transfer film 1, the thermal transfer layer 3 in its portion heated by the heat roll 13 is transferred onto the object 10 with the image 9 formed thereon (see FIG. 10).

An image may be formed on the object by a thermal ink transfer method or a thermal sublimable dye transfer method wherein the thermal transfer recording medium, as described above, comprising a substrate and, provided on the substrate, a heat-fusion ink layer or a sublimable dye ink layer as a thermal transfer ink layer is provided and is imagewise heated using a heat source, such as a thermal head, to form a thermally transferred image. The image may also be formed on the object by an electrophotographic method wherein an electrostatic latent image is formed on a photoreceptor by exposure and is developed with a toner, followed by the transfer of the toner image onto the object. Further, alternatively, the image may be formed on the object by an ink jet recording method wherein droplets of an ink jet recording ink are ejected through nozzles and are deposited onto the object.

In the method for image formation according to the present invention, means for imagewise heating used in forming an image on the thermal transfer layer in the thermal transfer film by the thermal transfer of the thermal transfer ink layer in the thermal transfer recording medium may be conventional thermal energy impartation means for thermal transfer, such as heating by means of a thermal head or laser beam irradiation.

Examples of means for transferring the thermal transfer layer, with an image formed thereon using the thermal transfer ink layer, onto an object include a thermal head usable in the formation of a transferred image, a line heater, a heat roll, and a hot stamp.

In the present invention, in order that the finally obtained image in the image formed object is oriented in a proper direction, an image having a mirror relationship with the final image on the object should be formed on the thermal transfer layer in the thermal transfer film.

The object with an image being formed thereon by the above method for image formation is an image formed object. The object, on which an image is to be formed, is not particularly limited. Examples thereof include sheets or three-dimensional molded products of plain paper, wood free paper, tracing paper, various plastics or the like. The object may be in the form of any of cards, postal cards, passports, letter papers or writing pads, report pads, notebooks, catalogs, cups, cases, building materials, panels, electronic components, such as telephones, radios, and televisions, rechargeable batteries and the like.

When an image is formed directly on an object by a thermal ink transfer method, a thermal sublimable dye transfer method, an electrophotographic method, or an ink jet recording method followed by the transfer of a thermal transfer layer on the image using the thermal transfer film according to the present invention, if necessary, a receptive layer may be formed on the object according to the recording method so that the recording material is easily received and fixed onto the object.

EXAMPLES

The following examples and comparative examples further illustrate the present invention, but are not intended to limit it. In the following description, "parts" or "%" is by weight.

Preparation of Thermal Transfer Films 1 to 15

Thermal transfer films 1 to 15 were prepared under conditions specified for each layer in Table 5. Specifically, a backside layer having a composition specified in Table 4 was coated at a coverage of 0.2 g/m$^2$ on a solid basis onto a substrate specified in Table 5. A release layer, a peel layer, and a thermal transfer layer were formed in that order on the other side of the substrate under conditions specified in Table 5. The composition of the release layer is shown in Table 5, and details of resins used are shown in Table 2.

The composition of the peel layer is shown in Table 5, and details of resins used are shown in Table 3.

The composition of the thermal transfer layer is shown in Table 5, and details of resins used are shown in Table 1.

TABLE 1

| | Tg, ° C. | Number average molecular weight | Carboxylic acid component | Alcohol component |
|---|---|---|---|---|
| Resin A1 | 65 | 20000 | Terephthalic acid/isophthalic acid | Ethylene glycol/neopentyl glycol |
| Resin A2 | 52 | 4000 | Terephthalic acid/isophthalic acid | Ethylene glycol/neopentyl glycol |
| Resin A3 | 75 | 15000 | Terephthalic acid/isophthalic acid | Ethylene glycol/neopentyl glycol/tricyclodecane glycol |
| Resin A4 | 80 | 8000 | Terephthalic acid/isophthalic acid | Ethylene glycol/tricyclodecane glycol |
| Resin A5 | 95 | 5000 | Terephthalic acid/isophthalic acid/trimellitic acid | Ethylene glycol/tricyclodecane glycol |
| Resin A6 | 20 | 10000 | Terephthalic acid/isophthalic acid/sebacic acid | Ethylene glycol/neopentyl glycol |

TABLE 2

| Water-soluble polyvinyl acetal for release layer | | |
|---|---|---|
| | Degree of acetalization mol % | Tradename |
| Resin D1 | 5–11 | KX–1 (Sekisui Chemical Co., Ltd.) |
| Resin D2 | 6–12 | KW–1 (Sekisui Chemical Co., Ltd.) |
| **Polyvinyl alcohol for release layer** | | |
| | Degree of saponification, mol % | Tradename |
| Resin E1 | 99.0–100 | NM-11 (Nippon Synthetic Chemical Industry Co., Ltd.) |
| Resin E2 | 98.5–99.4 | NH-20 (Nippon Synthetic Chemical Industry Co., Ltd.) |
| Resin E3 | 97.0–98.5 | AH-17 (Nippon Synthetic Chemical Industry Co., Ltd.) |
| Resin E4 | 86.5–89.0 | GH-14 (Nippon Synthetic Chemical Industry Co., Ltd.) |
| Resin E5 | 76.7–79.3 | KM-11 (Nippon Synthetic Chemical Industry Co., Ltd.) |

TABLE 3

| Methacrylate copolymer/homopolymer for peel layer | | | |
|---|---|---|---|
| | Tg, ° C. | Weight average molecular weight | Methacrylate component |
| Resin F1 | 105 | 40000 | Methyl methacrylate |
| Resin F2 | 105 | 25000 | Methyl methacrylate |
| Resin F3 | 75 | 30000 | Methyl methacrylate/n-butyl methacrylate |
| Resin F4 | 50 | 50000 | Methyl methacrylate/n-butyl methacrylate |
| Resin F5 | 85 | 35000 | Methyl methacrylate/iso-butyl methacrylate |
| Resin F6 | 105 | 95000 | Methyl methacrylate |

TABLE 4

| Composition of backside layer | Parts by weight |
|---|---|
| Styrene-acrylonitrile copolymer | 45 |
| Linear saturated polyester | 2 |
| Zinc stearyl phosphate | 21 |
| Powder of crosslinked urea resin | 21 |
| Powder of crosslinked melamine resin | 11 |

TABLE 5

| | Coverage of backside layer, g/m$^2$ | Substrate | Thermal transfer film: Release layer: Composition | Release layer: Coverage, g/m$^2$ | Peel layer: Composition | Peel layer: Coverage, g/m$^2$ | Thermal transfer layer: Composition | Thermal transfer layer: Coverage, g/m$^2$ |
|---|---|---|---|---|---|---|---|---|
| Thermal transfer film 1 | 0.2 | PET film with one side being corona treated (12 $\mu$m) | D1 | 0.2 | — | — | A5 alone | 4.0 |
| Thermal transfer film 2 | 0.2 | PET film with one side being corona treated (12 $\mu$m) | D1 | 0.2 | — | — | A5/A6 = 90/10 | 4.0 |
| Thermal transfer film 3 | 0.2 | PET film with one side being corona treated (12 $\mu$m) | D1 | 0.2 | — | — | A1/A5 = 50/50 | 7.0 |
| Thermal transfer film 4 | 0.2 | PET film with one side being corona treated (12 $\mu$m) | D1 | 0.2 | — | — | A1/A5/carnauba wax = 48/48/4 | 6.0 |
| Thermal transfer film 5 | 0.2 | PET film with one side being corona treated (12 $\mu$m) | D1 | 0.2 | — | — | A1/A5/silica = 49/49/2 | 6.0 |
| Thermal transfer film 6 | 0.2 | PET film with one side being corona treated (12 $\mu$m) | D2 | 0.5 | — | — | A3/A5 = 50/50 | 6.0 |
| Thermal transfer film 7 | 0.2 | PET film with one side being corona treated (12 $\mu$m) | D2 | 0.5 | F1/carnauba wax = 98/2 | 1.0 | A1/carnauba wax = 97/3 | 4.0 |
| Thermal transfer film 8 | 0.2 | PET film with one side being corona treated (12 $\mu$m) | — | — | F3/polyethylene wax = 98/2 | 2.0 | A2/A3 = 40/60 | 5.0 |
| Thermal transfer film 9 | 0.2 | PET film with one side being corona treated (12 $\mu$m) | D2 | 0.1 | F5/polyethylene wax = 98/2 | 1.0 | A4/carnauba wax = 98/2 | 5.0 |
| Thermal transfer film 10 | 0.2 | PET film with one side being corona treated (12 $\mu$m) | E1 | 0.2 | — | — | A1/A5 = 60/40 | 5.0 |
| Thermal transfer film 11 | 0.2 | PET film with one side being corona treated (12 $\mu$m) | E2 | 0.2 | — | — | A1/A5 = 60/40 | 5.0 |
| Thermal transfer film 12 | 0.2 | PET film with one side being corona treated (12 $\mu$m) | E3 | 0.2 | — | — | A1/A5 = 60/40 | 5.0 |
| Thermal transfer film 13 | 0.2 | PET film with one side being corona treated (12 $\mu$m) | E4 | 0.2 | — | — | A1/A5 = 60/40 | 5.0 |
| Thermal transfer film 14 | 0.2 | PET film with one side being corona treated (12 $\mu$m) | E5 | 0.2 | — | — | A1/A5 = 60/40 | 5.0 |
| Thermal transfer film 15 | 0.2 | PET film with one side being corona treated (12 $\mu$m) | D1 | 0.2 | — | — | A6 alone | 4.0 |

Preparation of Thermal Transfer Ink Sheet 1

Thermal transfer ink sheet 1 for the formation of color images was prepared under conditions specified for each layer in Table 6.

Object

A 200 $\mu$m-thick white flexible vinyl chloride sheet or a 200 $\mu$m-thick black polycarbonate sheet was provided as an object for the evaluation of the thermal transfer films.

TABLE 6

| | Coverage, g/m$^2$ | Substrate | Thermal transfer ink sheet: Composition of colored layer: Colorant | Weight ratio, % | Binder | Weight ratio, % | Other ingredient | Weight ratio, % | Coverage of colored layer, g/m$^2$ |
|---|---|---|---|---|---|---|---|---|---|
| Thermal transfer ink sheet 1 | 0.2 | Untreated PET (4.5 $\mu$m) | Aluminum pigment | 35 | Resin A5 | 65 | — | — | 1.0 |

Direct Transfer of Color Image

The object and the thermal transfer ink sheet were put on top of each other in combinations as specified in Table 7 so that one side of the object faced the colored layer in the thermal transfer ink sheet. The thermal transfer ink sheet was imagewise heated from the backside thereof by means of a thermal head to imagewise transfer the colorant alone or a combination of the colorant with the binder onto the object, whereby a color image was formed directly on the object. Thereafter, the object with the color image formed thereon and the thermal transfer film provided with a thermal transfer layer as specified in Table 7 were put on top of each other so that the image formed face in the object faced the thermal transfer layer in the thermal transfer film. In this state, the whole area of the thermal transfer film was then heated from the backside of the thermal transfer film by means of a heat roll covered with rubber heated at 180° C. to transfer the whole area of the thermal transfer layer in the thermal transfer film onto the object.

In this case, for printing of the color image, a printer for evaluation using heating by means of a thermal head was used under printing conditions of line speed 2.8 msec/line, pulse duty 80%, resolution of thermal head 300 dpi, resistance value of thermal head 1600 Ω, and applied voltage 17.5 V. The print pattern consisted of a letter of "ABC" having a size of 7 point.

TABLE 7

Thermal transfer films and results of evaluation thereof

| | Thermal transfer film | Ink sheet for formation of color image | Object | Image formation method | Transfer-ability | Abrasion resistance | Heat resistance |
|---|---|---|---|---|---|---|---|
| Example 1 | 1 | Thermal transfer ink sheet 1 | Polycarbonate | Direct transfer | ○ | ○ | ○ |
| Example 2 | 1 | Thermal transfer ink sheet 1 | " | Retransfer | ○ | ○ | ○ |
| Example 3 | 2 | Thermal transfer ink sheet 1 | " | Direct transfer | ○ | ○ | ○ |
| Example 4 | 2 | Thermal transfer ink sheet 1 | " | Retransfer | ○ | ○ | ○ |
| Example 5 | 3 | Thermal transfer ink sheet 1 | " | Direct transfer | ○ | ○ | ○ |
| Example 6 | 3 | Thermal transfer ink sheet 1 | " | Retransfer | ○ | ○ | ○ |
| Example 7 | 4 | Thermal transfer ink sheet 1 | " | Direct transfer | ○ | ○ | ○ |
| Example 8 | 4 | Thermal transfer ink sheet 1 | " | Retransfer | ○ | ○ | ○ |
| Example 9 | 5 | Thermal transfer ink sheet 1 | " | Direct transfer | ○ | ○ | ○ |
| Example 10 | 5 | Thermal transfer ink sheet 1 | " | Retransfer | ○ | ○ | ○ |
| Example 11 | 6 | Thermal transfer ink sheet 1 | " | Retransfer | ○ | ○ | ○ |
| Example 12 | 7 | Thermal transfer ink sheet 1 | " | Direct transfer | ○ | ○ | ○ |
| Example 13 | 7 | Thermal transfer ink sheet 1 | " | Retransfer | ○ | ○ | ○ |
| Example 14 | 8 | Thermal transfer ink sheet 1 | " | Direct transfer | ○ | ○ | ○ |
| Example 15 | 8 | Thermal transfer ink sheet 1 | " | Retransfer | ○ | ○ | ○ |
| Example 16 | 9 | Thermal transfer ink sheet 1 | " | Direct transfer | ○ | ○ | ○ |
| Example 17 | 9 | Thermal transfer ink sheet 1 | Polycarbonate | Retransfer | ○ | ○ | ○ |
| Example 18 | 10 | Thermal transfer ink sheet 1 | " | Direct transfer | ○ | ○ | ○ |

TABLE 7-continued

Thermal transfer films and results of evaluation thereof

| | Thermal transfer film | Ink sheet for formation of color image | Object | Image formation method | Transfer-ability | Abrasion resistance | Heat resistance |
|---|---|---|---|---|---|---|---|
| Example 19 | 10 | Thermal transfer ink sheet 1 | " | Retransfer | ○ | ○ | ○ |
| Example 20 | 11 | Thermal transfer ink sheet 1 | " | Direct transfer | ○ | ○ | ○ |
| Example 21 | 11 | Thermal transfer ink sheet 1 | " | Retransfer | ○ | ○ | ○ |
| Example 22 | 12 | Thermal transfer ink sheet 1 | " | Direct transfer | ○ | ○ | ○ |
| Example 23 | 12 | Thermal transfer ink sheet 1 | " | Retransfer | ○ | ○ | ○ |
| Example 24 | 13 | Thermal transfer ink sheet 1 | " | Direct transfer | ○ | ○ | ○ |
| Example 25 | 13 | Thermal transfer ink sheet 1 | " | Retransfer | ○ | ○ | ○ |
| Example 26 | 14 | Thermal transfer ink sheet 1 | " | Direct transfer | ○ | ○ | ○ |
| Example 27 | 14 | Thermal transfer ink sheet 1 | " | Retransfer | ○ | ○ | ○ |
| Comparative Example 1 | 15 | Thermal transfer ink sheet 1 | " | Direct transfer | ○ | X | X |
| Comparative Example 2 | 15 | Thermal transfer ink sheet 1 | " | Retransfer | ○ | X | X |
| Comparative Example 3 | 1 except that A5 has been changed to cellulose acetate butyral*1 | Thermal transfer ink sheet 1 | " | Retransfer | X | X | ○ |

*1CAB381-0.5, manufactured by Eastman Chemical Co., Ltd.

Retransfer of Color Image

The thermal transfer film provided with a thermal transfer layer and the thermal transfer ink sheet prepared by the above method and a combination as specified in Table 7 were put on top of each other so that the thermal transfer layer in the thermal transfer film faced the colored layer in the thermal transfer ink sheet. In this state, the thermal transfer ink sheet was then imagewise heated from the backside thereof by means of a thermal head to imagewise transfer the colorant alone or a combination of the colorant with the binder onto the thermal transfer layer in the thermal transfer film, whereby a color image was formed on the thermal transfer layer in the thermal transfer film. Thereafter, an object and the thermal transfer film provided with a thermal transfer layer having thereon a color image were put on top of each other so that the object faced the thermal transfer layer in the thermal transfer film. In this state, the whole area of the thermal transfer film was then heated from the backside thereof by means of a heat roll covered with rubber heated at 180° C. to transfer the whole area of the thermal transfer layer in the thermal transfer film. Thus, a color image, which was protected by the thermal transfer layer, was formed on the object.

In this case, the color image was printed under the same conditions as used in the formation of the image directly on the object.

The thermal transfer films provided with a thermal transfer layer provided in Examples 1 to 27 and Comparative Examples 1 to 3, the thermal transfer ink sheet for the formation of a color image, and the object were used in combination as specified in Table 7, and a color image and the thermal transfer layer were transferred and formed on the object by the method as specified in Table 7.

The image formed objects and the thermal transfer films prepared above were evaluated for the following items.

Transferability

The image formed objects formed by the above method was visually inspected for the following items to evaluate the transferability.

Transfer failure (a part of the thermal transfer layer in the thermal transfer film was not transferred)

Tailing (the thermal transfer layer transferred onto the object was projected from the end of the object)

Abrasion Resistance

The object with a color image and a thermal transfer layer formed thereon by transfer was subjected to a 200-revolution abrasion resistance test with a TABER tester using a truck wheel CS-10F. under a load of 500 gf, and the object was then inspected for a loss of the color image.

Heat Resistance

The thermal transfer films were put on top of each other so that the thermal transfer layer in one of the thermal transfer films faced the backside layer in the other thermal transfer film. The assembly was stored at 50° C. for two days and was then inspected for blocking.

The results of evaluation for the examples and the comparative examples were as shown in Table 7.

What is claimed is:

1. A method for image formation using a thermal transfer film, comprising:

forming an image on an image surface of an object by a thermal ink transfer method, a thermal dye sublimation method, an electrophotographic method, or an ink jet recording method;

placing the object having the formed image a top surface of the thermal transfer film so that the image surface faces a thermal transfer layer of the thermal transfer film; and heating the thermal transfer film from a bottom surface opposite from the top surface, so that the thermal transfer layer is transferred onto to image surface;

wherein:

the thermal transfer film comprises a substrate, the thermal transfer layer and a release layer located between the substrate and the thermal transfer layer, the thermal transfer layer forming the top surface of the thermal transfer film;

the release layer is substantially inseparable from the substrate;

the thermal transfer layer comprises at least a first polyester resin and a second polyester resin, the first and second polyester resins having different number average molecular weights;

the first polyester resin has a number average molecular weight of from 1,000 to 10,000 and a glass transition temperature of from 80 to 100° C.;

the second polyester resin has a number average molecular weight of from 10,000 to 30,000.

* * * * *